US005406302A

United States Patent [19]

Killinger

[11] Patent Number: 5,406,302

[45] Date of Patent: Apr. 11, 1995

[54] MATRIX-SHAPED DISPLAY DEVICE

[75] Inventor: Erich Killinger, Gaggenau, Germany

[73] Assignee: Dambach-Werke GmbH, Germany

[21] Appl. No.: 45,491

[22] Filed: Apr. 8, 1993

[30] Foreign Application Priority Data

Apr. 13, 1992 [DE] Germany ..... 42 12 125.6

[51] Int. Cl.[6] ..... G09G 3/34

[52] U.S. Cl. ..... 345/55; 345/84; 340/815.41

[58] Field of Search ..... 345/54, 55, 59, 67, 345/111, 84; 340/815.4, 815.41

[56] References Cited

U.S. PATENT DOCUMENTS

| | | | |
|---|---|---|---|
| 2,589,569 | 3/1952 | Peter et al. . | |
| 3,389,389 | 6/1968 | Minear | 345/111 |
| 3,553,645 | 1/1971 | Finkel . | |
| 3,593,029 | 7/1971 | Sakaguchi et al. | 250/219 |
| 3,899,786 | 8/1975 | Greubel et al. | 340/815.31 |
| 3,962,702 | 6/1976 | Kriege . | |
| 3,963,326 | 6/1976 | Buchert | 350/266 |
| 4,060,307 | 11/1977 | Demaine et al. | 358/120 |
| 4,106,231 | 8/1978 | MacNiel | 40/547 |
| 4,163,332 | 8/1979 | Salam | 345/111 |
| 4,299,447 | 11/1981 | Soltan et al. | 359/42 |
| 4,646,074 | 2/1987 | Hashimoto | 345/206 |
| 4,747,648 | 5/1988 | Gilliland, III | 356/31 |
| 4,794,391 | 12/1988 | Costa et al. | 340/815.31 |
| 4,833,806 | 5/1989 | Gars | 40/447 |
| 4,839,635 | 6/1989 | Harris et al. | 345/55 |
| 4,914,427 | 4/1990 | Trunk | 345/111 |
| 4,965,488 | 10/1990 | Hihi | 313/499 |
| 5,021,773 | 6/1991 | Browne | 345/111 |
| 5,053,765 | 10/1991 | Sonehara et al. | 345/55 |
| 5,055,832 | 10/1991 | Browne | 345/110 |
| 5,160,921 | 11/1992 | Killinger | 345/84 |

FOREIGN PATENT DOCUMENTS

| | | | |
|---|---|---|---|
| 36086 | 7/1988 | Austria . | |
| 2047911 | 2/1992 | Canada | 345/55 |
| 2831174 | 1/1979 | Germany . | |
| 7931474 | 4/1980 | Germany . | |
| 3031246 | 3/1982 | Germany . | |
| 3128329 | 1/1983 | Germany . | |
| 8124380 | 3/1983 | Germany . | |
| 8318633 | 12/1983 | Germany . | |
| 3303917 | 8/1984 | Germany . | |
| 3012816 | 12/1984 | Germany . | |
| 3319179 | 1/1985 | Germany . | |
| 3434355 | 6/1986 | Germany . | |
| 3511839 | 10/1986 | Germany . | |
| 3021502 | 5/1987 | Germany . | |
| 3812418 | 10/1989 | Germany . | |
| 8913499 | 3/1990 | Germany . | |
| 4024499 | 9/1991 | Germany . | |
| 8900093 | 8/1990 | Netherlands . | |
| 2051447 | 1/1981 | United Kingdom . | |

OTHER PUBLICATIONS

"Glasvezeltechniek: veilige en veelzijdige signalering", Uit, vol. 3, No. 1, Jan. 1986.

Mutze, Karl, "ABC der Optik", pp. 492–493. Catalog: "Annax Alphanumerisches Anzeigesystem".

*Primary Examiner*—Ulysses Weldon
*Assistant Examiner*—Amare Mengistu
*Attorney, Agent, or Firm*—Speckman, Pauley & Fejer

[57] ABSTRACT

A display device having matrix points arranged in n columns and m lines and comprising four partial image points of different colors distributed on two half-columns and two half-lines. Each partial image point has an optical fiber correspondingly illuminated in color, the light-emitting end of which can be covered and uncovered by a pulsed, electrically triggerable magnetically bistable flap. The electromagnets of the flap are controlled with a setting and a setting reference potential for uncovering the ends of the optical fibers, and with a return and a return reference potential for covering the ends of the optical fibers, by a control device in accordance with display information selected from a memory device. By renewed triggering of the matrix, arbitrary display information can be displayed very rapidly and with a simple design of the matrix and the control device.

19 Claims, 3 Drawing Sheets

MATRIX-SHAPED DISPLAY DEVICE

BACKGROUND OF THE INVENTION

1. Field of the Invention

This invention relates to a display device having a matrix of matrix points arranged in columns and lines. Each respective matrix point comprises four partial image points of different colors distributed on respectively two half-columns and two half-lines. Every partial image point is formed by the end of an optical fiber correspondingly illuminated in color, the light-emitting end of which can be covered and uncovered by a bistable flap which is controllable with the aid of an electromagnet in a pulsed manner. The electromagnets of the flap are controlled with a set and a set reference potential for uncovering the ends of the optical fibers, and with a reset and a reset reference potential for covering the ends of the optical fibers, by a control device in accordance with display information selected from a memory device.

2. Description of Prior Art

A display device of this type is disclosed by German Patent Publication DE 89 13 499 U1. In this known display device, individual partial control devices are associated with interlaced individual matrices which are supplied with partial display information from a central control. The display information is composed of the partial display information. In this case, the partial control devices trigger the associated partial image points through individual control lines.

This type of control of a matrix with four interlaced partial matrices not only requires a large control effort, but also extensive wiring of the matrix. In addition, the setting of the matrix is only rapid if the partial control devices trigger all partial image points to be set in a parallel manner. This, in turn, entails a great amount of set switches in the partial control devices, because one individual set switch must-be provided for each partial image point.

A circuit arrangement for a display device having a matrix of bistable matrix points is disclosed by German Patent Publication DE 40 24 499 C1, in which the columns or the lines are subsequently triggered for checking, in the course of which all matrix points of the column or of each line are always set or reset. However, a display cannot be set or cancelled with this circuit arrangement because, as a rule, only a portion of the matrix points of a column or line is set. In addition, in the display, a matrix point can only be reproduced in one color.

SUMMARY OF THE INVENTION

It is an object of this invention to provide a display device as discussed above by which a desired display can be represented rapidly and in different colors with a considerably reduced outlay for the control.

This object is achieved by a display device in accordance with one embodiment of this invention in which, in the column direction, the electromagnets of the flaps are sequentially triggered in half-columns by a column control device, wherein it is possible respectively in a first partial step to apply the reset reference potential and in a second partial step to apply the set reference potential to the triggered half-column. The electromagnets of the flaps are triggered parallel in the line direction by a line control device, wherein, in the first partial step of column triggering, the reset potential is applied to respectively all half-lines and, in the second partial step of the column triggering, the respective partial display information corresponding to the triggered half-column is applied as the set potential to the respectively associated half-lines. In accordance with another embodiment of this invention, in an equally advantageous manner, the electromagnets of the flaps are sequentially triggered in the column direction by a column control device, wherein, in a reset cycle, the reset reference potential is applied to the respective triggered half-column and, in the course of each column triggering, the reset potential is simultaneously applied by a line control device to respectively all half-lines. In a set cycle, the electromagnets of the flaps are triggered sequentially with the set reference potential in half-columns by the column control device, wherein, in the course of each column triggering, the respective partial display information associated with the triggered half-column is applied to the associated half-lines as the set potential.

By the division of the matrix points into half-columns and half-lines, all half-matrices can be set by half-columns in one triggering cycle with correspondingly preset partial display information. In this connection, the control lines are reduced in the column direction to the number of the half- columns, that is, double the number of the columns in the matrix, and the control lines in the line direction are reduced to the number of half-lines in the matrix. Triggering is carried out serially in the column direction and parallel in the line direction so that setting, as well as resetting, of the partial image points can take place very rapidly, particularly because the set and reset pulses need only be applied for a few milliseconds for operating the flaps.

In accordance with one embodiment of the display device of this apparatus, the structure of the matrix is as follows. Each half-line has a reset line as well as a set line. Each reset line is connected to one of the connectors of all electromagnets of the flaps of the associated half-line through rectifiers which conduct the reset potential. Each set line is connected to one of the connectors of all electromagnets of the flaps of the associated half-line through rectifiers which conduct the set potential. The other connectors of the electromagnets of the flaps are connected to associated half-columns control lines, the column control device has reset switches for the individual half-columns and set switches for the individual half-columns, and the line control device has reset switches for the individual half-lines and set switches for the individual half-lines.

The column control device and the line control device can be triggered by a display control device, for example a processor, to which the display information is supplied from a memory in the form of partial display information for the individual half- columns.

For the display of a text, the memory preferably contains the display information in half-columns and half-lines as values "0" and "1", wherein the value "1" means setting the associated flap into the uncovered position.

BRIEF DESCRIPTION OF THE DRAWINGS

This invention will be better understood from the following detailed description in conjunction with the drawings wherein.

DESCRIPTION OF PREFERRED EMBODIMENTS

Figure 1:
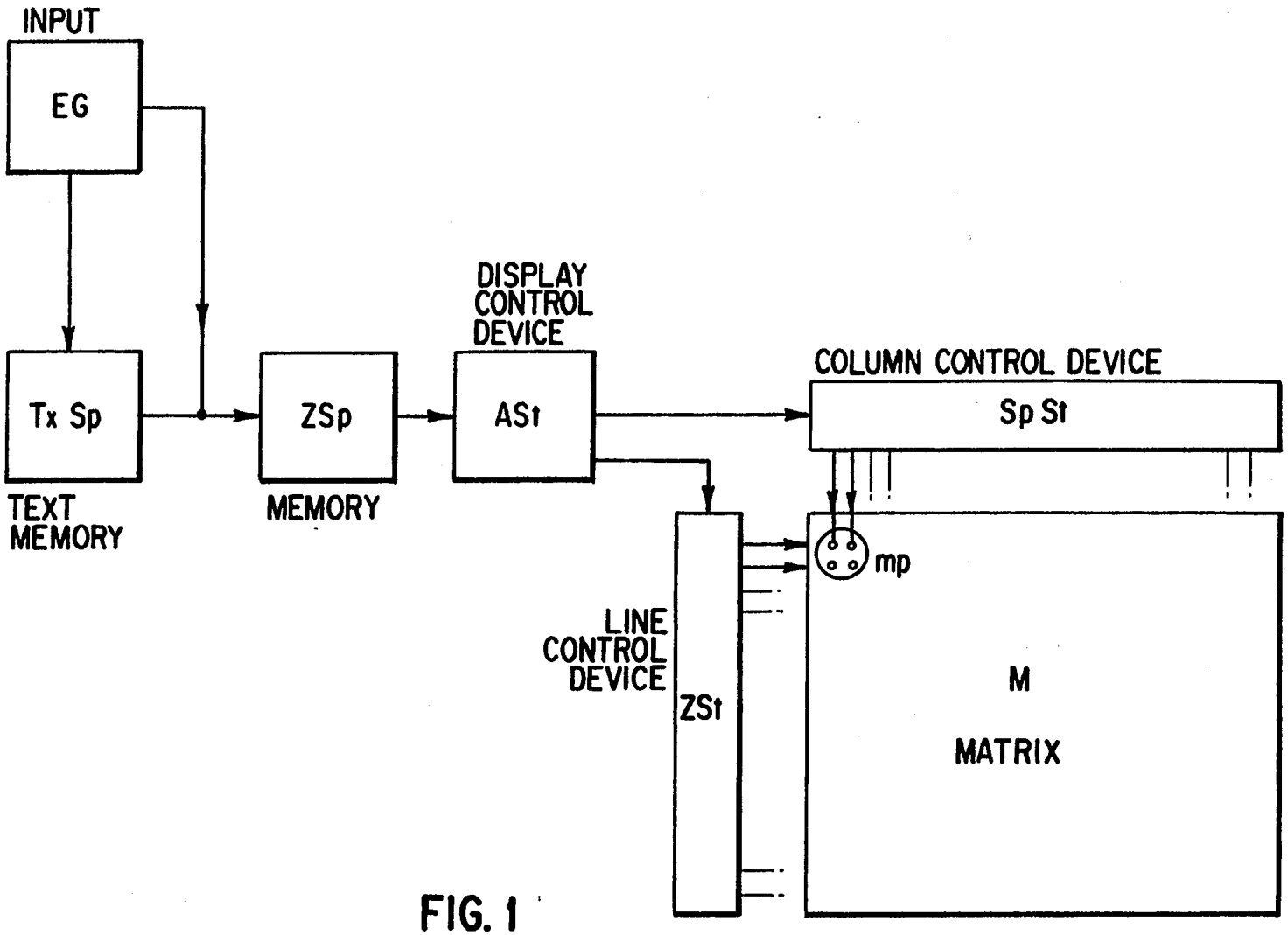
FIG. 1 is a block diagram of a display device in accordance with one embodiment of this invention.

As can be seen from FIG. 1, a column control device SpSt and a line control device ZSt correspond to a matrix M having matrix points mp with four partial image points of different colors. A central display control device ASt controls the column control device SpSt and the line control device ZSt. The display information to be displayed by the matrix M is preset through an input EG. Various pieces of display information are stored in a memory ZSp. As shown, it is also possible to select a defined text through a text memory TxSpo In this case, the memory ZSp converts the letters of the text into partial display information and places them in the fields preset in the matrix M.

Figure 2:
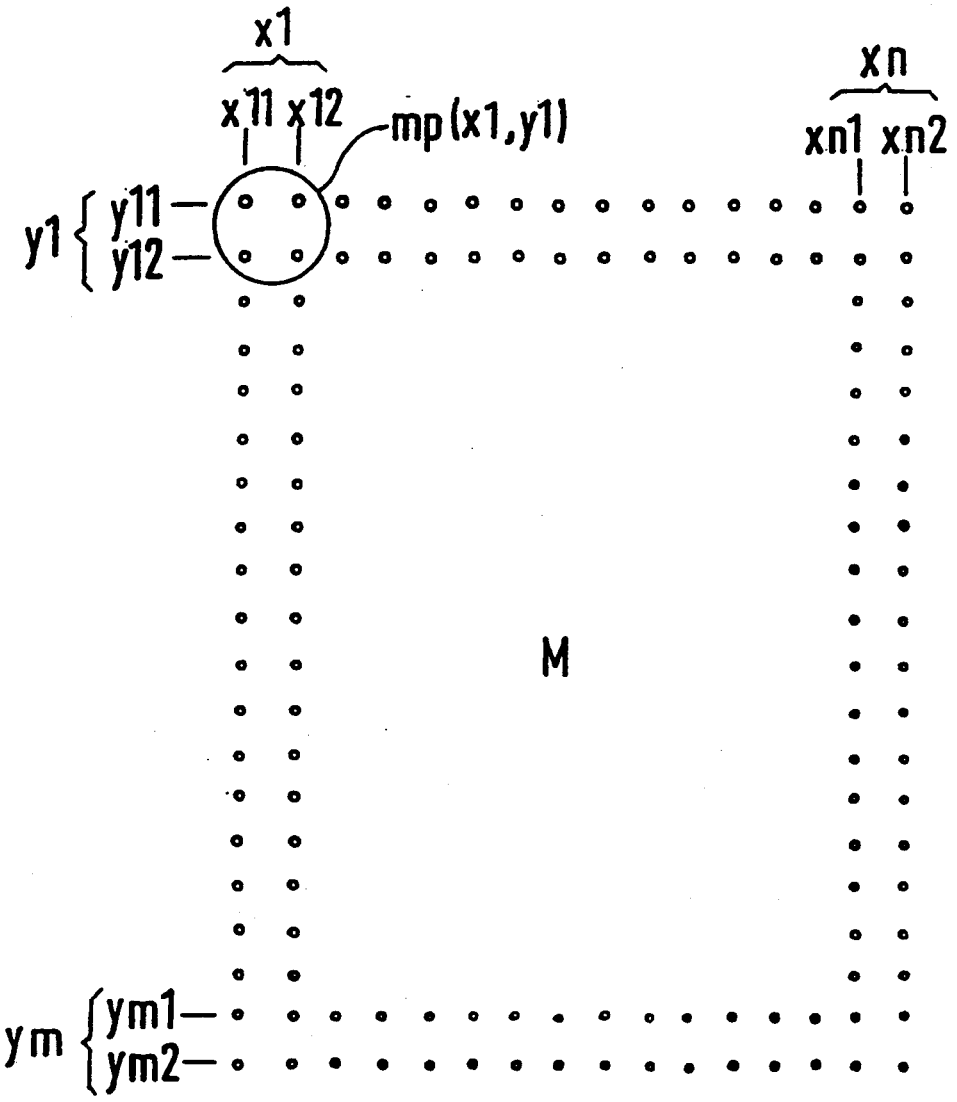
FIG. 2 is a schematic diagram of the structure of the matrix of the display device in accordance with one embodiment of this invention.
Figure 3:
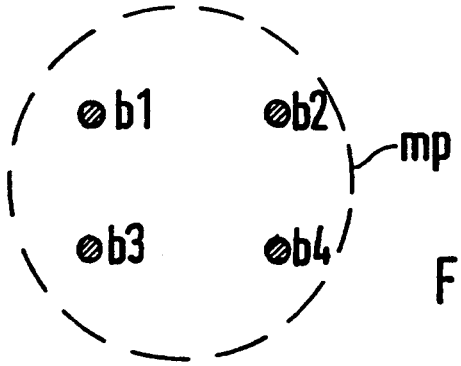
FIG. 3 is a schematic diagram of a matrix point of the matrix of the display device in accordance with one embodiment of this invention.

The structure of the matrix M is schematically shown in FIG. 2. Each partial image point of the matrix point mp has an optical fiber which is illuminated in the color assigned to the partial matrix. The optical fibers of a partial matrix can be combined into an optical fiber bundle and simultaneously illuminated through an appropriate filter. The end of each optical fiber from which the light emerges is covered and uncovered by a flap so that the partial image point with the corresponding color can be included in the display or eliminated from the display. In this way, as shown schematically in FIG. 3, the partial image point b1 can be white, the partial image point b2 yellow, the partial image point b3 green and the partial image point b4 red. This arrangement of a matrix point mp is repeated in all columns x1 to xn and in all lines y1 to ym. For control, the columns x1 to xn are divided into half-columns x11, x12 to xn1, xn2 with corresponding control lines, and the lines y1 to ym are divided into half-lines y11, y12 to ym1, ym2 with corresponding control lines.

The control information contained in or supplied to the display control device ASt corresponds to the display information, wherein the value "0" indicates a covered optical fiber and the value "1" indicates an uncovered optical fiber. With the columns x1 to xn and the half-columns x11, x12 to xn1, xn2 and with the lines y1 to ym and the half-lines y11, y12 to ym1, ym2, the structure of the control information corresponds to the structure of the matrix M. A half-column x11, x12 to xn1, xn2 forms a partial display information TInf, which is transferred parallel into the corresponding half-column x11, x12 to xn1, xn2 on the matrix M.

Figure 4:
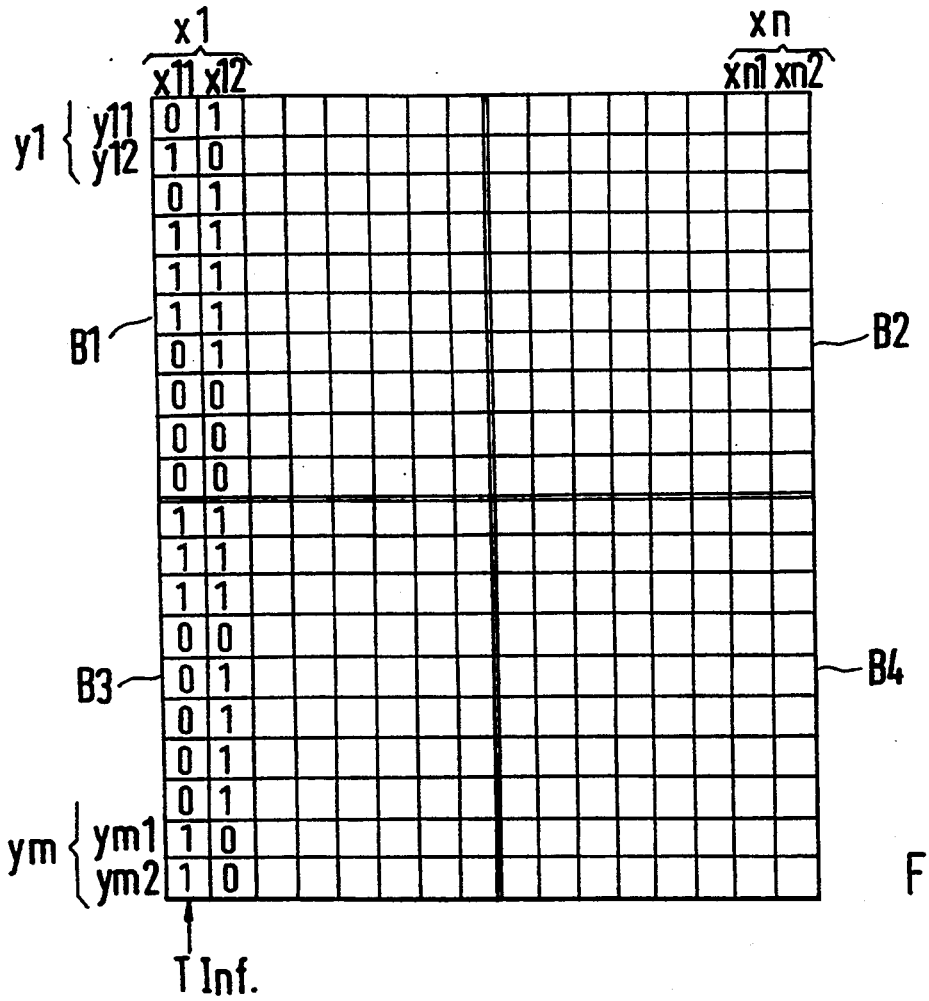
FIG. 4 is a schematic diagram of the structure of the display information in the memory supplying display information.

As shown by FIG. 4, the display information can be divided, like the matrix M, into a plurality of fields of equal size B1, B2, B3, B4, etc. The fields B1, B2, B3, B4 are sufficiently large so that a letter of a text can be outlined. If a defined text is preset by the text memory TxSp, it is then possible with the aid of the memory ZSp to convert one letter of the text after the other into the corresponding partial display information. The display control device ASt positions the partial display information in the associated field B1, B2, B3, B4 of the matrix M. This operation is repeated until the text has been set letter by letter in the matrix M into the appropriate fields B1, B2, B3, B4.

Figure 5:
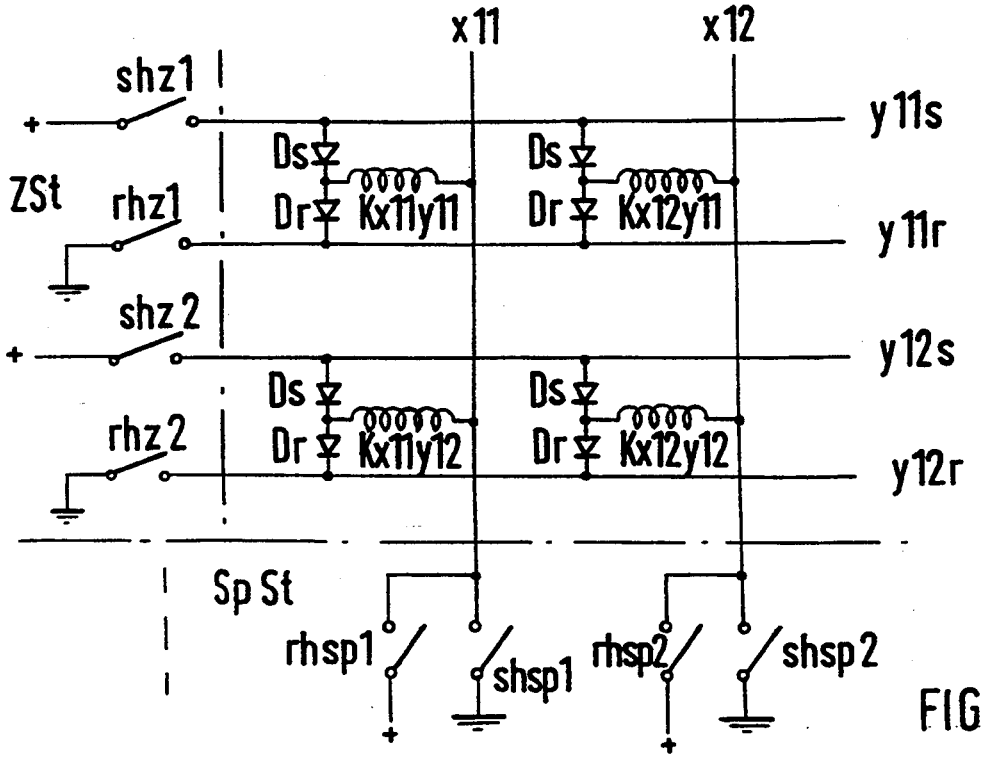
FIG. 5 is a schematic diagram of the matrix point with the flaps and control lines of the display device in accordance with one embodiment of this invention.

FIG. 5 illustrates the electrical structure of a matrix point mp (x1, y1) with four electromagnets Kx11y11, Kx12y11, Kx11y12 and Kx12y12 of the flaps. These electromagnets of the flaps are connected to one of the connectors to the corresponding control lines of the half-columns x11 and x12. The other respective connectors lead through two rectifiers Ds and Dr, respectively, to the set line and the reset line of the associated half-line y11 or y12. The electromagnet Kx11y11 of the flap is assigned to the half-column x11 and the half-line y11; the electromagnet Kx12y11 of the flap is assigned to the half-column x12 and the half-line y11; the electromagnet Kx11y12 of the flap is assigned to the half-column x11 and the half-line y12; and the electromagnet Kx12y12 of the flap is assigned to the half-column x12 and the half-line y12.

The half-line y11 has a set line y11s and a reset line y11r and the half-line y12 has a set line y12s and a reset line y12r. A set switch shz1 or shz2 is assigned to each set line y11s or y12s, which connects the set potential + with the set line y11s or y12s through the rectifier Ds. During setting, the selected half-column x11 or x12 is connected through the set switch shsp1 or shsp2 to the set reference potential ground.

A reset switch rhz1 or rhz2 corresponds to each reset line y11r or y12r and connects the reset potential ground to the reset line rhz1 or rhz2 through the rectifier Dr. During resetting, the selected half-column x11 or x12 is connected through a reset switch rhsp1 or rhsp2 to the reset potential +. The rectifiers Ds and Dr are connected in such a way that, during setting or resetting, the current flow in either direction takes place through the electromagnet of the flap. A pulse of short duration is sufficient here. By residual induction, the flap is kept in the set position until triggering of the electromagnet in the respective other current direction takes place.

The control cycle can take place in two ways. Setting and resetting can include its own cycle. Prior to setting a new display information, all flaps are reset into the cover position. This is carried out by sequentially changing the half-columns x11, x12 to xn1,xn2 with the reset potential + through their reset switches rhsp1 or rhsp2. During triggering of a half-column x11, x12 to xn1, xn2, all reset lines y11r or y12r are always charged with the reset reference potential ground through the reset switches y11r or y12r. As a result, all set flaps of the selected half-column are reset in one step into their cover positions. Once the reset cycle has been performed, it is possible in a set cycle to set the flaps half-column by half-column in accordance with the display information of FIG. 4. The information assigned to the matrix point mp (x1, y1) will lead to setting of the electromagnet Kx11y12 of the corresponding flap when the half-column x11 is triggered and, when the half-column x12 is triggered, to setting of the electromagnet Kx12y11 of the corresponding flap. At the end of the set cycle, all partial display information TInf of the display information has been transferred into the half-columns x11, x12 to xn1, xn2 of the matrix M. The corresponding flaps uncover the partial image points and the matrix M shows the corresponding display. In this connection, the partial image points of each matrix point mp can be arbitrarily set or not set.

It is also possible to interlace the set cycle and the reset cycle. Before a selected half-column x11, x12 to nx1, nx2 is set, the half-column x11, x12 to xn1, xn2 is first reset in a first partial step and is then set in accordance with the associated partial display information TInf. This has the advantage that the half-column x11, x12 to xn1, xn2 need only be addressed once. The reset and set operation is repeated with each newly selected half-column x11, x12 to xn1, xn2 until the cycle has been performed on the last half-column x11, x12 to xn1, xn2 and is terminated. A new display information is then overwritten from half-column to half-column.

What is claimed is:

1. In a display device having a matrix of matrix points arranged in columns and lines, each of said columns divided into two half-columns and each of said lines divided into two half-lines, each of said matrix points comprising four partial image points of different colors distributed on said two half-columns and said two half-lines, each of said partial image points formed by a light-emitting end of an optical fiber illuminated in color, each of said light-emitting ends being coverable and uncoverable by a bistable flap controllable with an electromagnet in a pulsed manner, and each of said electromagnets of said bistable flap controllable with a set and a set reference potential for uncovering each of said ends of said optical fibers and with a reset and a reset reference potential for covering each of said ends of said optical fibers by a control device in accordance with display information selected from a memory device, the improvement comprising:

in each of the columns (x1 . . . xn), each of the electromagnets (Kx11y11; Kx11y12; Kx12y11; Kx12y12; . . . ) of the flaps being sequentially triggerable in said half-columns by a column control device (SpSt); in a first partial step, a reset reference potential (+) being applied and, in a second partial step, a set reference potential (ground) being applied to the respectively triggered half-column (x11, x12); and each of said electromagnets (Kx11y11; Kx11y12; Kx12y11; Kx12y12; . . . ) of the flaps being triggerable parallel in each of the lines (y1 . . . ym) by a line control device (ZSt); in the first partial step of column triggering, the reset potential (ground) being applied to all half-lines (y11, y12 . . . ym1, ym2) and, in the second partial step of the column triggering, a respective partial display information (TInf) corresponding to the triggered half-column (x11, x12 . . . xn1, xn2) being applied as set potential (+) to the corresponding half-lines (y11, y12 . . . ym1, ym2).

2. In a display device having a matrix of matrix points arranged in columns and lines, each of said columns divided into two half-columns and each of said lines divided into two half-lines, each of said matrix points comprising four partial image points of different colors distributed on said two half-columns and said two half-lines, each of said partial image points formed by a light-emitting end of an optical fiber illuminated in color, each of said light-emitting ends being coverable and uncoverable by a bistable flap controllable with an electromagnet in a pulsed manner, and each of said electromagnets of said bistable flap controllable with a set and a set reference potential for uncovering each of said ends of said optical fibers and with a reset and a reset reference potential for covering each of said ends of said optical fibers by a control device in accordance with display information selected from a memory device, the improvement comprising:

in each of the columns (x1 . . . xn), each of the electromagnets (Kx11y11; Kx11y12; Kx12y11; Kx12y12; . . . ) of the flaps being sequentially triggerable in half-columns by a column control device (SpSt); in a reset cycle, a reset reference potential (+) being applied to the respective triggered half-column (x11, x12 . . . xn1, xn2) and, in the course of each column triggering, a reset potential (ground) being simultaneously applied by a line control device (ZSt) to all half-lines (y11, y12 . . . ym1, ym2); and in a set cycle, the electromagnets (Kx11y11; Kx11y12; Kx12y11; Kx12y12; . . . ) of the flaps sequentially triggerable with a set reference potential (ground) in said half-columns (x11, x12 . . . xn1, xn2) by said column control device (SpSt); in the course of each column triggering, the respective partial display information (TInf) corresponding to the triggered half-column (x11, x12 . . . xn1, xn2) being applied to the corresponding half-lines (y11, y12 . . . ym1, ym2) as the set potential (+).

3. In a display device in accordance with claim 1, wherein each of said half-lines (y11, y12 . . . ym1, ym2) has a reset line (y11r, y12r . . . ) and a set line (y11s, y12s . . . ), each of said reset lines (y11r, y12r . . . ) is connected to one of the connectors of all electromagnets (Kx11y11; Kx11y12; Kx12y11; Kx12y12; . . . ) of the flaps of the corresponding half-line (y11, y12 . . . ym1, ym2) through at least one rectifier (Dr) which conducts one of the reset potential (+) and the reset potential (ground), each of said set lines (y11s, y12s . . . ) is connected to one of the connectors of all electromagnets (Kx11y11; Kx11y12; Kx12y11; Kx12y12; . . . ) of the flaps of the corresponding half-line (y11, y12 . . . ym1, ym2) through at least one rectifier (Ds) which conducts one of the set potential (ground) and the set potential (+), the other connectors of the electromagnets (Kx11y11; Kx11y12; Kx12y11; Kx12y12; . . . ) of the flaps are connected to corresponding half-columns control lines, and the column control device (SpSt) has a column reset switch (rhsp1, rhsp2, . . . ) for each of said half-columns and a column set switch (shsp1, shsp2, . . . ) for each of said half-columns and the line control device (ZSt) has a line reset switch (rhz1, rhz2, . . . ) for each of said half-lines and a line set switch (shz1, shz2, . . . ) for each of said half-lines.

4. In a display device in accordance with claim 1, wherein the column control device (SpSt) and the line control device (ZSt) are triggerable by a display control device (ASt) to which the display information is supplied from a memory (ZSp) in the form of partial display information for each of said half-columns.

5. In a display device in accordance with claim 4, wherein said memory (ZSp) comprises the display information in said half- columns (x11, x12 . . . xn1, xn2) and said half-lines (y11, y12 . . . ym1, ym2) as values "0" and "1", the value "1" corresponding to setting the electromagnets (Kx11y11; Kx11y12; Kx12y11; Kx12y12; . . . ) of the corresponding flap into the uncovered position.

6. In a display device in accordance with claim 4, wherein for the display information embodied as a text, the matrix (M) is divided into a plurality of equal fields (B1, B2, B3, B4 . . . ), the size of said fields being adapted to the display of a letter, and the partial display information associated with the letters is taken from the memory (ZSp) by the control of a text memory (TxSp).

7. In a display device in accordance with claim 3, wherein the column control device (SpSt) and the line control device (ZSt) are triggerable by a display control device (ASt) to which the display information is supplied from a memory (ZSp) in the form of partial display information for each of said half-columns.

8. In a display device in accordance with claim 7, wherein said memory (ZSp) comprises the display information in said half- columns (x11, x12 . . . xn1, xn2) and said half-lines (y11, y12 . . . ym1, ym2) as values "0" and "1", the value "1" corresponding to setting the electromagnets (Kx11y11; Kx11y12; Kx12y11; Kx12y12; . . . ) of the corresponding flap into the uncovered position.

9. In a display device in accordance with claim 7, wherein for the display information embodied as a text, the matrix (M) is divided into a plurality of equal fields (B1, B2, B3, B4 . . . ), the size of said fields being adapted to the display of a letter, and the partial display information associated with the letters is taken from the memory (ZSp) by the control of a text memory (TxSp).

10. In a display device in accordance with claim 8, wherein for the display information embodied as a text, the matrix (M) is divided into a plurality of equal fields (B1, B2, B3, B4 . . . ), the size of said fields being adapted to the display of a letter, and the partial display information associated with the letters is taken from the memory (ZSp) by the control of a text memory (TxSp).

11. In a display device in accordance with claim 2, wherein each of said half-lines (y11, y12 . . . ym1, ym2) has a reset line (y11r, y12r . . . ) and a set line (y11s, y12s . . . ), each of said reset lines (y11r, y12r . . . ) is connected to one of the connectors of all electromagnets (Kx11y11; Kx11y12; Kx12y11; Kx12y12; . . . ) of the flaps of the corresponding half-line (y11, y12 . . . ym1, ym2) through at least one rectifier (Dr) which conducts one of the reset potential (+) and the reset potential (ground), each of said set lines (y11s, y12s . . . ) is connected to one of the connectors of all electromagnets (Kx11y11; Kx11y12; Kx12y11; Kx12y12; . . . ) of the flaps of the corresponding half-line (y11, y12 . . . ym1, ym2) through at least one rectifier (Ds) which conducts one of the set potential (ground) and the set potential (+), the other connectors of the electromagnets (Kx11y11; Kx11y12; Kx12y11; Kx12y12; . . . ) of the flaps are connected to corresponding half-columns control lines, and the column control device (SpSt) has a column reset switch (rhsp1, rhsp2, . . . ) for each of said half-columns and a column set switch (shsp1, shsp2, . . . ) for each of said half-columns and the line control device (ZSt) has a line reset switch (rhz1, rhz2, . . . ) for each of said half-lines and a line set switch (shz1, shz2, . . . ) for each of said half-lines.

12. In a display device in accordance with claim 2, wherein the column control device (SpSt) and the line control device (ZSt) are triggerable by a display control device (ASt) to which the display information is supplied from a memory (ZSp) in the form of partial display information for each of said half-columns.

13. In a display device in accordance with claim 12, wherein said memory (ZSp) comprises the display information in said half- columns (x11, x12 . . . xn1, xn2) and said half-lines (y11, y12 . . . ym1, ym2) as values "0" and "1", the value "1" corresponding to setting the electromagnets (Kx11y11; Kx11y12; Kx12y11; Kx12y12; . . . ) of the corresponding flap into the uncovered position.

14. In a display device in accordance with claim 12, wherein for the display information embodied as a text, the matrix (M) is divided into a plurality of equal fields (B1, B2, B3, B4 . . . ), the size of said fields being adapted to the display of a letter, and the partial display information associated with the letters is taken from the memory (ZSp) by the control of a text memory (TxSp).

15. In a display device in accordance with claim 13, wherein for the display information embodied as a text, the matrix (M) is divided into a plurality of equal fields (B1, B2, B3, B4 . . . ), the size of said fields being adapted to the display of a letter, and the partial display information associated with the letters is taken from the memory (ZSp) by the control of a text memory (TxSp).

16. In a display device in accordance with claim 11, wherein the column control device (SpSt) and the line control device (ZSt) are triggerable by a display control device (ASt) to which the display information is supplied from a memory (ZSp) in the form of partial display information for each of said half-columns.

17. In a display device in accordance with claim 16, wherein said memory (ZSp) comprises the display information in said half- columns (x11, x12 . . . xn1, xn2) and said half-lines (y11, y12 . . . ym1, ym2) as values "0" and "1", the value "1" corresponding to setting the electromagnets (Kx11y11; Kx11y12; Kx12y11; Kx12y12; . . . ) of the corresponding flap into the uncovered position.

18. In a display device in accordance with claim 16, wherein for the display information embodied as a text, the matrix (M) is divided into a plurality of equal fields (B1, B2, B3, B4 . . . ), the size of said fields being adapted to the display of a letter, and the partial display information associated with the letters is taken from the memory (ZSp) by the control of a text memory (TxSp).

19. In a display device in accordance with claim 17, wherein for the display information embodied as a text, the matrix (M) is divided into a plurality of equal fields (B1, B2, B3, B4 . . . ), the size of said fields being adapted to the display of a letter, and the partial display information associated with the letters is taken from the memory (ZSp) by the control of a text memory (TxSp).

* * * * *